US009550220B2

(12) United States Patent
Cernuschi et al.

(10) Patent No.: US 9,550,220 B2
(45) Date of Patent: Jan. 24, 2017

(54) THREE-ROLLING STAND WITH LATERAL CHANGE

(71) Applicant: Danieli & C. Officine Meccaniche S.p.A., Buttrio (IT)

(72) Inventors: Ettore Cernuschi, Castelletto Sopra Ticino (IT); Aristide Giacomo Bertelli, Bresso (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 0 days.

(21) Appl. No.: 14/783,213

(22) PCT Filed: Apr. 11, 2014

(86) PCT No.: PCT/EP2014/057395
§ 371 (c)(1),
(2) Date: Oct. 8, 2015

(87) PCT Pub. No.: WO2014/167102
PCT Pub. Date: Oct. 16, 2014

(65) Prior Publication Data

US 2016/0067754 A1 Mar. 10, 2016

(30) Foreign Application Priority Data

Apr. 11, 2013 (IT) ..... MI2013A0590

(51) Int. Cl.
*B21B 13/10* (2006.01)
*B21B 31/10* (2006.01)
*B21B 17/14* (2006.01)

(52) U.S. Cl.
CPC ..... *B21B 13/10* (2013.01); *B21B 13/103* (2013.01); *B21B 31/10* (2013.01); *B21B 17/14* (2013.01)

(58) Field of Classification Search
CPC ..... B21B 13/10; B21B 13/103; B21B 17/14; B21B 2031/026; B21B 31/08; B21B 31/10; B21B 31/20; B21B 31/32
See application file for complete search history.

(56) References Cited

U.S. PATENT DOCUMENTS 371,424 A * 10/1887 Clifford et al. ..... B21B 13/103 72/224
2,495,387 A * 1/1950 Rummins ..... B21B 13/103 72/224

(Continued)

FOREIGN PATENT DOCUMENTS

DE 2747518 A 4/1979
WO WO98/06515 2/1998
WO WO2011/132094 10/2011

*Primary Examiner* — Edward Tolan
(74) *Attorney, Agent, or Firm* — Stetina Brunda Garred & Brucker

(57) ABSTRACT

A method and a device for releasing a tube during a rolling process in a three-roll rolling stand in case of an emergency. The roll holder cartridge (3) has a longitudinal open slot (10) at the yoke support of the vertical axis roll so as to remove the roll holder cartridge according to a direction coinciding with the horizontal axis of the yoke support of the vertical axis roll while the support remains anchored to the fixed structure in the stand of the roll mill. In case of routine maintenance, the cartridge (3) is pulled out laterally with the yoke support of the vertical axis roll anchored to the cartridge itself as the other roll supports.

6 Claims, 9 Drawing Sheets

(56) References Cited

U.S. PATENT DOCUMENTS

| | | | | |
|---|---|---|---|---|
| 4,366,694 | A * | 1/1983 | Pariseau | B21B 31/08 72/235 |
| 6,276,181 | B1 * | 8/2001 | Kusakabe | B21B 13/103 72/224 |
| 2015/0128678 | A1 * | 5/2015 | Cernuschi | B21B 17/14 72/224 |

* cited by examiner

THREE-ROLLING STAND WITH LATERAL CHANGE

CROSS REFERENCE TO RELATED APPLICATIONS

The present application claims priority to PCT International Application No. PCT/EP2014/057395 filed on Apr. 11, 2014, which application claims priority to Italian Patent Application No. MI2013A000590 filed Apr. 11, 2013, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a three-roll rolling stand used in rolling mills for manufacturing seamless tubular bodies or rod-shaped bodies in general.

STATE OF THE ART

Rolling mills for the longitudinal rolling of tubes or rod-shaped bodies in general comprise rolling mill assemblies with two or more rolls per stand. A rolling stand of the known type typically comprises, for each roll:

- a hydraulic capsule for adjusting the radial position of the rolling axis with respect to rolling axis of the roll mill;
- a control extension, e.g. an extension with universal joint, Cardan type and grooved coupling to be engaged on the roller hub, in order to transmit the rotary motion to the roll;
- a motor and a reducer arranged at the other end of the control extension and connected thereto.

In particular, when three-roll rolling stands are used, the rolls of each rolling stand are held assembled in operating position by a roll holder cartridge which makes fitting and removing the rolling rolls easier. Indeed, the use of the roll holder cartridge allows to extract the three rolls from the roll mill simultaneously when changing the rolls for normal maintenance.

In one type of roll mill of the prior art, the roll holder cartridges are changed by sliding them with transverse movement with respect to the rolling axis. In this case, the cartridges are therefore changed from the side with respect to the mill stand, and in particular in the systems in which the hydraulic capsules for adjusting and controlling the rolling pressure are rigidly fixed to the outer frame of the rolling stand, the lengths of the piston strokes of the capsules are designed so as to allow the pistons of the capsules to be retracted clear of the path of the roll holder cartridge when laterally extracting the roller holder cartridge itself from the roll mill. On the other hand, the rolling of tubes in roll mills with three or more rolls per stand implies the need to operate with hydraulic capsules for adjusting the radial position of the rolls which have a limited working stroke of the order of 100-150 mm. Indeed, since the rolling process needs to be discontinuous due to the presence of the mandrel, which must be inserted and removed from each rolled tube, when the head end passes within each stand, the pressure inside the main chamber of the hydraulic capsule suddenly increases, and because the oil itself can be elastically compressed, the piston of the capsule will normally retract by a few tens of a millimeter, thus generating an undesired extra thickness of the wall of the tube in the end zone. This phenomenon is accentuated during the passage through each stand, by the gradual hardening of the metal of the tube because, due to radiation, the ends of the tube will always be colder and thus more resistant to deformation as they travel along the rolling line. For this reason, the capsule must necessarily have a limited stroke to ensure suitability of the control dynamics. e.g. by means of specific servo valves.

A three-roll rolling stand with lateral extraction of the roll holder cartridge is described in WO2011/132094. In a roll mill of this type, if the tube jams during the rolling operation, at least one roll with corresponding yoke support is removed from the operating position, thus rotating the support and the roll about an axis parallel to the rolling axis.

In addition to being complicated, such an operation ensures however a limited space for cutting the sticked tube by means of a gas cutting torch, thus making the cutting operation longer and more laborious. A system which does not imply this type of complication and which allows to cut the sticked tube faster would be very useful.

SUMMARY OF THE INVENTION

It is the object of the present invention to provide a rolling stand for rolling rod-shaped bodies, also of large size, which reduces the intervention time and amount in case of emergencies caused by the sticking of a tube during the rolling process. The present invention thus wants to achieve the aforesaid objects by manufacturing a rolling stand according to claim 1, defining a rolling axis comprising a support structure, a roll holder cartridge configured to go from a working position inside the support structure, at said rolling axis, to an extracted position outside the fixed support structure with a transverse movement with respect to the rolling axis, three rolling rolls, each of which having a corresponding yoke support, arranged in the roll holder cartridge with its own axes arranged at 120° with respect to one another, a first roll of said three rolling rolls having its rotation axis arranged vertically, at least one hydraulic capsule for each rolling roll fixed to the support structure for adjusting the radial position of the respective rolling roll, with a respective thrust cylinder, the hydraulic capsule being configured to allow the respective thrust cylinder to cover a sufficient distancing stroke from the rolling axis to allow the path of the roll holder cartridge between the working position and the extracted position to be cleared, wherein the roll holder cartridge has a longitudinal open slot, the central axis of which coincides with the longitudinal central axis of the yoke support of the first roll, and a width in vertical direction greater than the diameter of the tube being rolled, said open slot being closed at a first end near the rolling axis and open at a second end opposite to the first end and coinciding with a side of the roll holder cartridge, considering the position taken by the roll holder cartridge when it is inserted in the rolling stand.

In case of sticking of the tube being rolled, the yoke support which supports the roll arranged with its axis vertically during the rolling process is advantageously released from the roll holder cartridge and remains hanging from the structure of the stand, while the cartridge and the other two rolls which have inclined axes during the rolling process are removed from the side of the rolling stand structure.

A particularly advantageous position, in which the yoke support and the vertical axis roll thereof are left in case of sticker, is that in which the roll and yoke support remain coupled to the roller spaced apart from the rolling axis and hanging from the fixed external structure by means of the respective hydraulic capsule. Thereby, the separation of the roll holder cartridge from said roll and support assembly is facilitated. This suspended, hanging position of the capsule is achieved by virtue of the two supporting planes present on the yoke support of the roll in the distal zone of the roll, firming a 'V'-shaped seat with respect to the horizontal axis of the respective capsule so as to centre the yoke support of the vertical axis roll on the complementary 'V'-shaped seat provided on the fixed support structure. Such planes are provided so as to align the sliding surfaces of the yoke support with the respective guides present on the roll holder cartridge when the roll holder cartridge enters and exits from the fixed structure of the stand. In order to withhold the yoke support of the vertical axis roll onto the capsule, once it has been released from the roll holder cartridge, a coupling device coaxial to the hydraulic capsule of the retractable hammer head type and rotational about its axis is provided; the existing balancing device of each roll is advantageously used for the purpose.

It is a further object of the invention a method according to claim 6 for releasing a sticked tube from a rolling stand according to the invention as described above during rolling operations, such a method comprising in sequence the following steps:

a) releasing the retainer between the yoke support of the vertical axis roll and the roll holder cartridge,
b) releasing the extensions,
c) shifting the roll holder cartridge from the working position to the extraction position, if the position of the rolling cartridge is higher than the position of the cartridge itself during the step of side extracting,
d) retracting the piston of the horizontal hydraulic capsule corresponding to the vertical axis roll so as to move the corresponding yoke support into contact with inclined planes.
e) maintaining the balancing force during the time needed to avoid the sliding of the yoke support of the vertical axis roll on the inclined planes or the tipping thereof due to the unbalanced weight.
f) extracting the roll holder cartridge leaving the tube and the corresponding mandrel inside the stand and the yoke support with the corresponding vertical axis roll on the support structure.

Thereby, the problem of accessibility of the rolling axis in case of sticker of a tube in the machine is solved by the solution suggested with the present invention.

BRIEF DESCRIPTION OF THE DRAWINGS

Further features and advantages of the present invention will become apparent in the light of the detailed description of a preferred, but not exclusive, embodiment of a rolling stand shown by the way of non-imitative example, with reference to the accompanying drawings, in which.

Equal reference numbers in the various figures correspond to the same elements or components.

DETAILED DESCRIPTION OF A PREFERRED EMBODIMENT OF THE INVENTION

Figure 1:
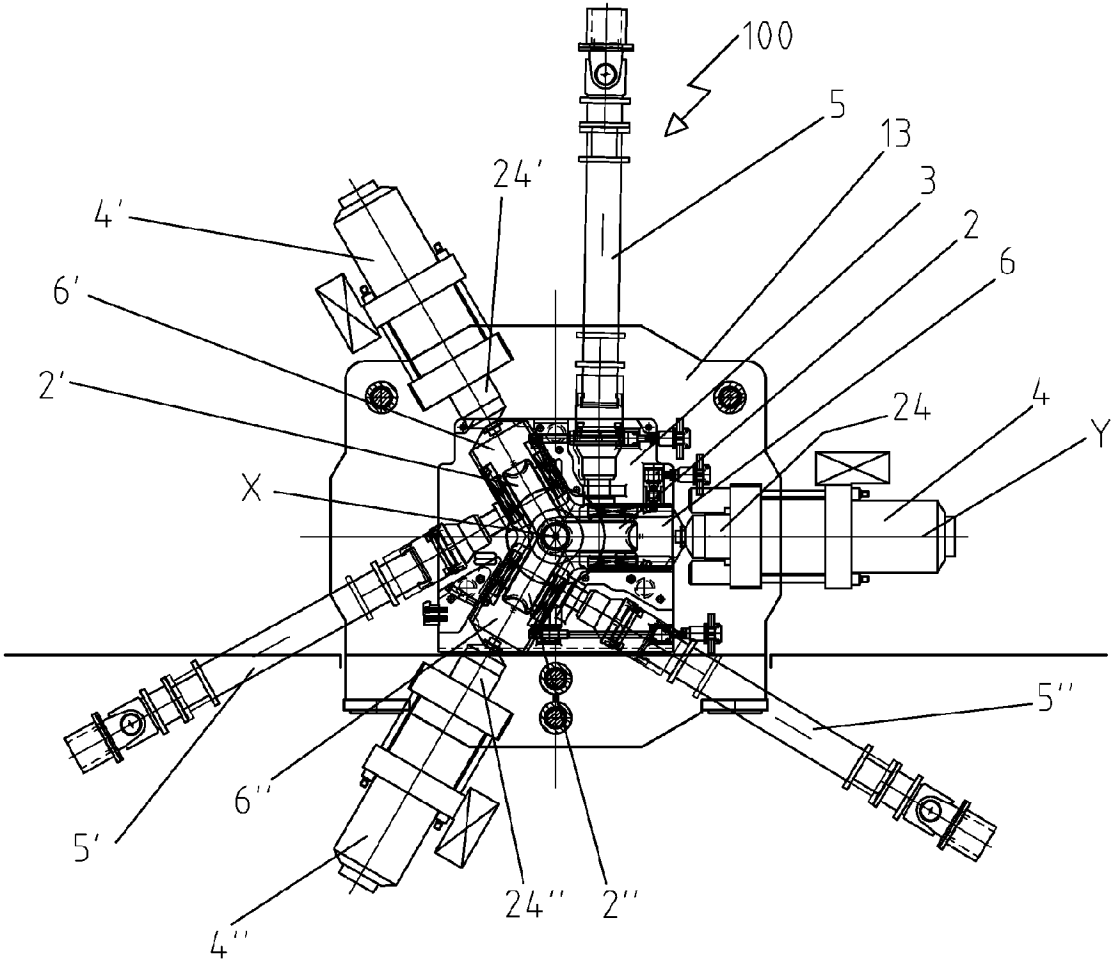
FIG. 1 is a side view of a rolling stand according to invention.
Figure 6:
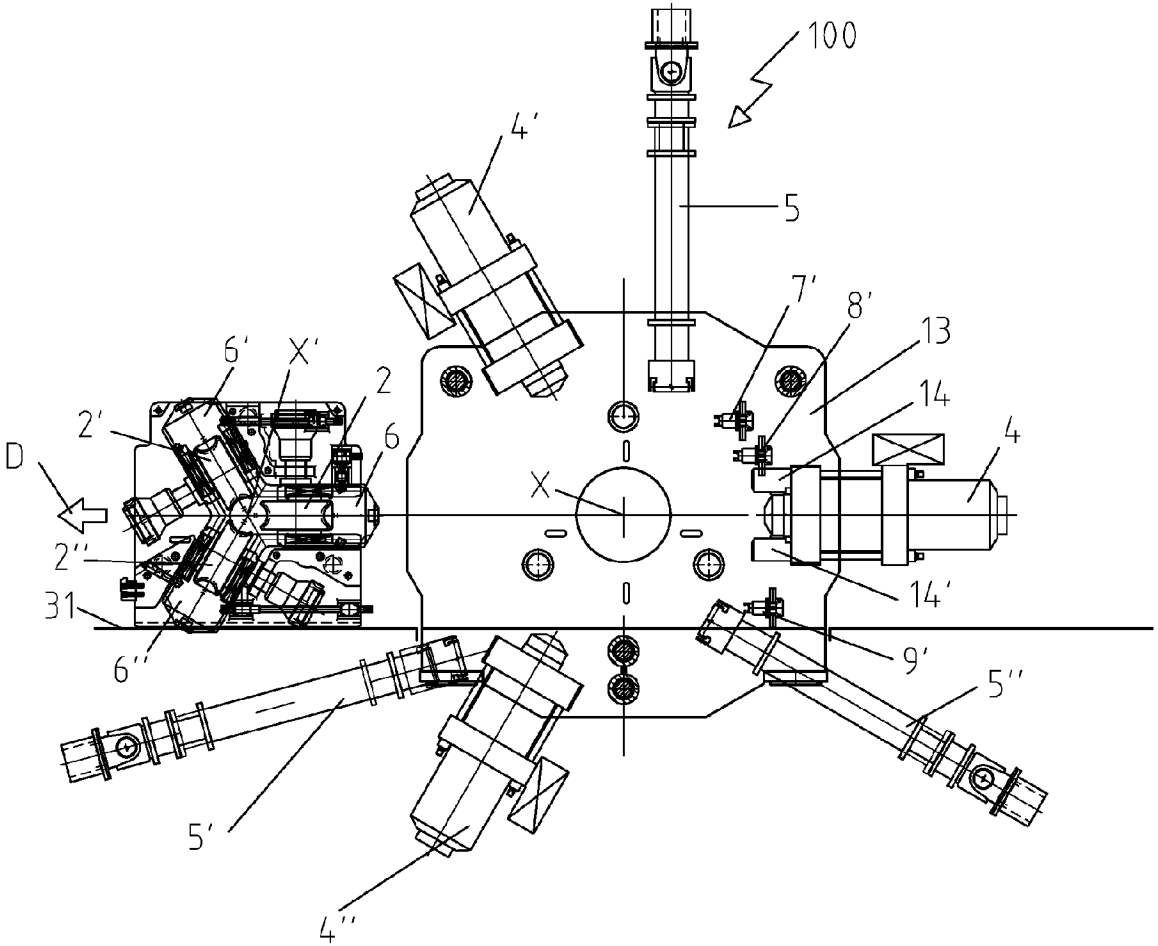
FIG. 6 is a section of a rolling stand according to the invention in a step following that in FIG. 5.

FIG. 1 shows a rolling stand 100 of a roll mill with several stands in line and each comprising three working rolls 2, 2' and 2" arranged in a roll holder cartridge 3, centered on a rolling axis X. Each roll is connected to a respective motor (not shown). A hydraulic capsule 4, 4', 4" is provided in each rolling stand 100 for each rolling roll (also referred to as working roll) 2, 2', 2" for adjusting the radial position of roll 2, 2', 2" with respect to the rolling axis of the roll mill and to react to the separation force during rolling. Advantageously, the hydraulic capsules 4, 4', 4" are all the same with corresponding piston 24, 24', 24" having an appropriate working stroke and which are rigidly fixed to die fixed structure 13 of the roll mill onto which they relieve the reaction forces generated during rolling. In each rolling stand 100, a first hydraulic capsule 4 is arranged with the symmetry axis Y thereof horizontal, while the other two hydraulic capsules 4' and 4" are appropriately inclined with respect to the vertical by an angle of +/−30°, and configured so as to have an opening of the piston such as to allow to extract the roll holder cartridge 3 in horizontal direction from the side opposite to the hydraulic capsule 4. The hydraulic capsules 4, 4' and 4" have a global stroke which comprises, in turn, a first stretch of working stroke for adjusting the radial portion of the roll and a second stretch of distancing stroke of the piston from the rolling axis X to allow to change the rolls 2, 2', 2", by extracting the roll holder cartridge 3 from the side with respect to the rolling stand 100 in the direction of the arrow D (FIG. 6). The extensions 5, 5', 5" transmit the rotation to the rolls 2, 2', 2" connecting them to the respective motors and reducers (not shown in the figure being features which are known to a person skilled in the art). The rolls 2, 2' and 2" are fitted with respective chock in the respective yoke shaped supports 6, 6', 6". The yoke supports 6, 6', 6" are provided with a balancing device that is coaxial with the piston of the respective hydraulic capsules 4, 4', 4" provided with hammer head fastening mechanism 25, 25', 25" that is retractable and rotational with respect to the symmetry axis thereof. The roll holder cartridge 3 is also provided with radial guides 20, 20', 21, 21', 22, 22' which allow the sliding movement of the yoke supports 6, 6', 6", provided with sliding surfaces 26, 26', 27, 27', 28, 28' complementary of the radial guides 20, 20', 21, 21', 22, 22' and the respective rolls 2, 2', 2" along the axis thereof and their possible extraction from cartridge 3, sliding in radial direction with respect to point X' (FIG. 2), coinciding with the rolling axis when the cartridge is fitted in operating condition in the rolling stand 100. Cartridge 3 is indeed open at said radial guides 20, 20', 21, 21', 22, 22' to allow the radial sliding of the yoke supports 6, 6', 6" of the rolls without necessarily needing to remove the cartridge. Before extracting the roll holder cartridge 3 from the rolling stand 100 it is necessary to uncouple the hydraulic capsules, the balancing system and the control extensions of the respective working rolls. Means are therefore provided for releasing the extensions from the rolling rolls, while the ends of the rods of the balancing system are removed from the respective grooves of the yoke supports 6, 6', 6" so as not to obstruct the lateral extraction movement of cartridge 3. Inside the structure of the roll mill, a pair of rails perpendicular to the rolling axis is provided for each rolling stand for the sliding of the roll holder cartridge 3. For this purpose, the roll holder cartridge 3 is provided with shoes 30 for sliding on the rails 31; wheels (not shown) may be used instead of the shoes for sliding on the rails 31. Actuation means. e.g. hydraulic cylinders (not shown), are provided under the roll holder cartridge 3, which push cartridge 3 upwards to align the centre X' of cartridge 3 with the rolling axis X and with the symmetry axis Y of capsule 4. The roll holder cartridge 3 (FIG. 2) is indeed provided with horizontal 11 and vertical 12 alignment devices for correctly positioning cartridge 3 in axis with the structure 13.

Figure 4:
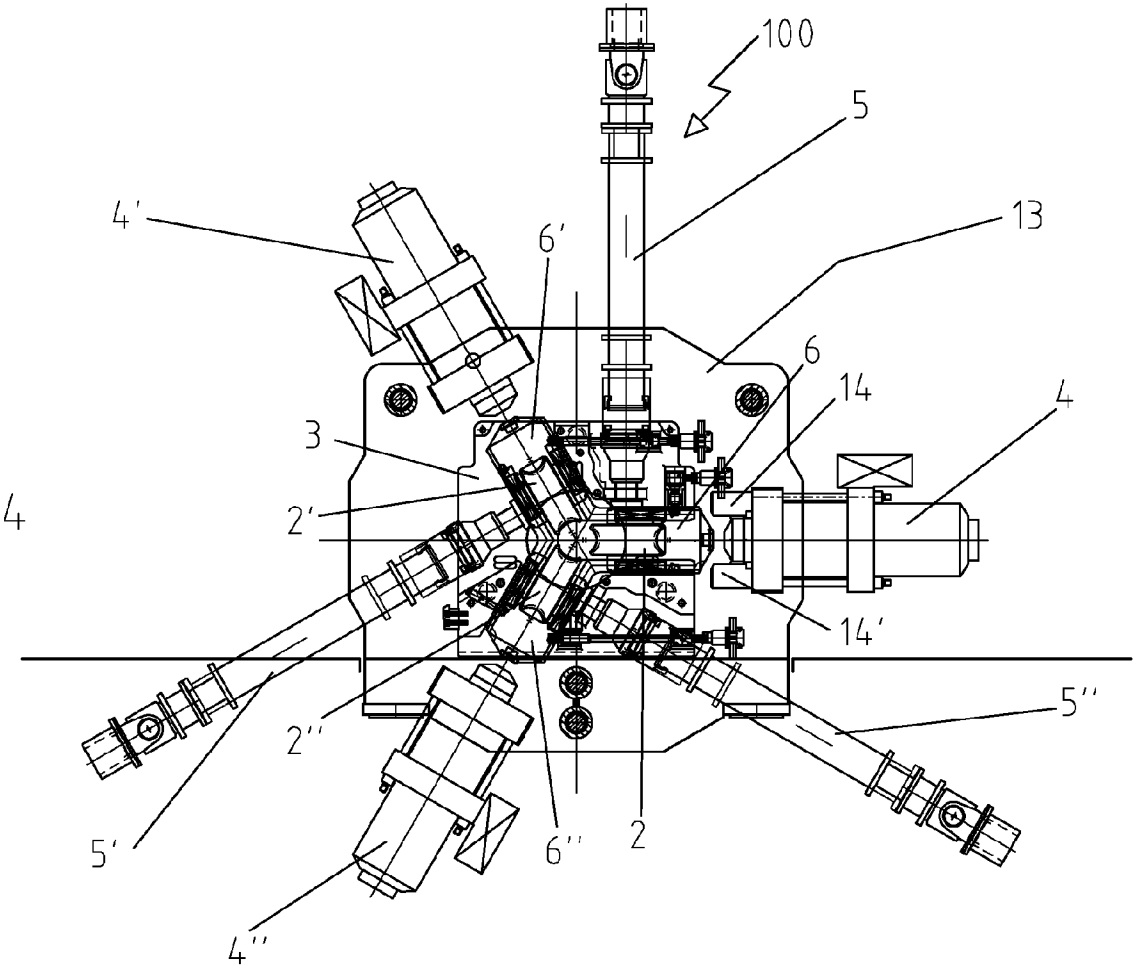
FIG. 4 shows a section along a longitudinal plane of a rolling stand according to the invention with the roll holder cartridge during a step of extracting carried out under normal operating conditions.
Figure 5:
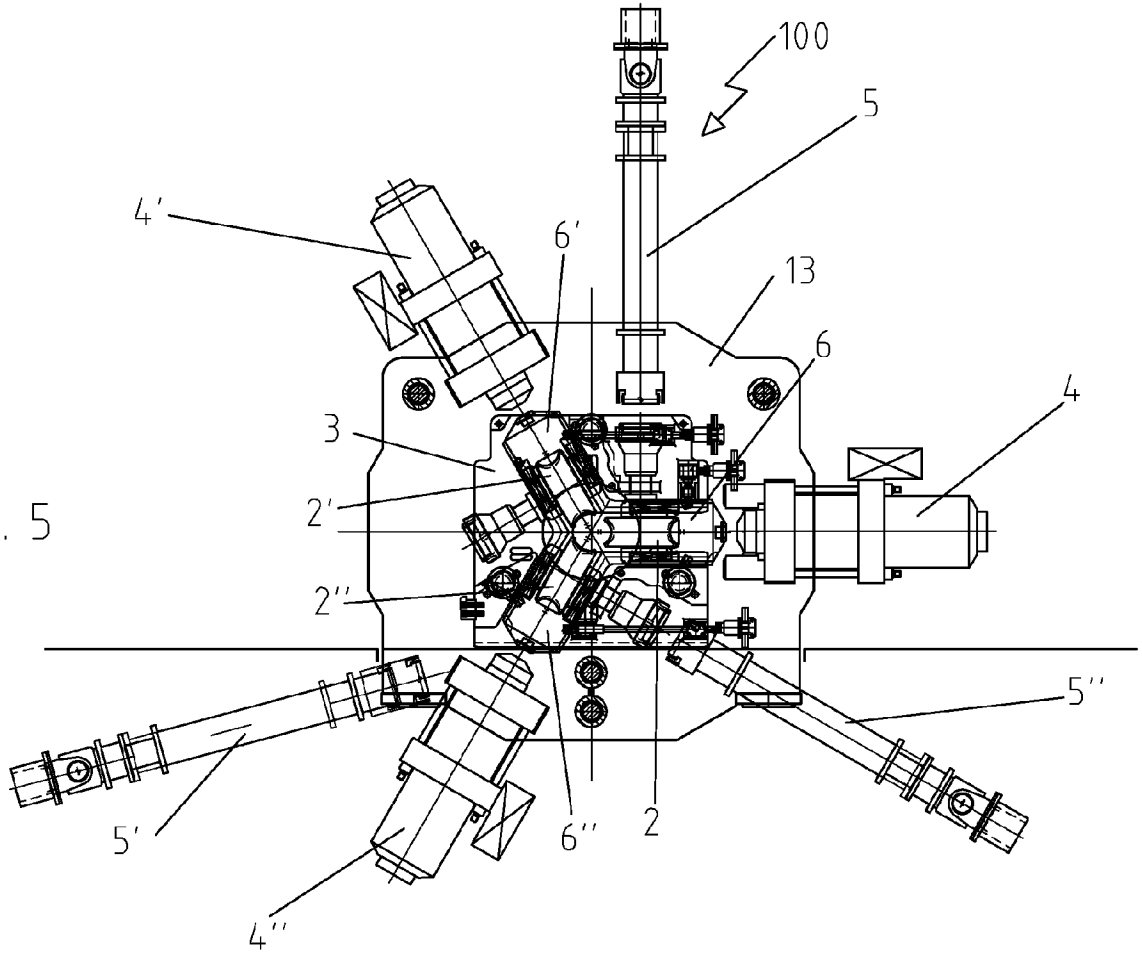
FIG. 5 is a section of a rolling stand according to the invention in a step following that in FIG. 4.

When it is extracted from stand 100, cartridge 3 is lowered by 5-10 mm to make it rest on the rails 31, while after re-introduction cartridge 3 is raised to align it with the respective alignment devices 1. The rolls 2, 2', 2" must be held fixed with respect to cartridge 3 to prevent a radial sliding during the handling of cartridge 3 in order to transport the roll holder cartridge 3. The rolling stand thus comprises a device the actuation of which may lock the position of the yoke supports 6, 6', 6" of the rolls 2, 2', 2" within the roll holder cartridge 3 before performing the lateral extraction of the cartridge from the rolling stand. Such a locking device comprises three actuators 7', 8', 9' and three respective retainer pins 7, 8, 9, and is shaped so that the actuators actuate the three retainer pins so that each of the retainer pins 7, 8, 9, locks the respective yoke support 6, 6', 6" onto the structure of cartridge 3 to prevent the radial sliding. The locking device may thus work on the three yoke supports 6, 6', 6" also at the same time. The actuators 7', 8', 9' are integrally mounted on the fixed structure 13 of the rolling stand and not on cartridge 3. The three retainer pins 7, 8, 9, instead, are integral with cartridge 3 but may rotate, either independently or simultaneously, about an axis thereof, between a first position, in which the yoke support is free to slide radially, and a second support position, in which the yoke is restrained. Once the yoke supports 6, 6', 6" are restrained, the respective hydraulic capsules 4, 4', 4" have been released therefrom and the extensions 5, 5', 5" have been released, the extension 5' relative to roll 2' can be moved so as to leave the passage for the roll holder cartridge 3 so that these may be extracted laterally in the direction of the arrow D, see FIGS. 4, 5 and 6, for example for routine maintenance.

In case of sticker, which is instead an exceptional, undesired situation, this is not possible in principle, given the obstacle created by the tube which could be crushed and by the mandrel which is inserted in the tube and which cannot be pulled out axially. It is thus advantageous to improve accessibility by operators to the rolling axis X, e.g. to cut the tube and the mandrel (not shown). Since the yoke support 6 of the vertical axis roll 2 of each stand is fitted on radial guides and the morphology of the cartridge allows the radial extraction of the yoke support itself for normal operations, we have thought to design cartridge 3 and the fixed structure 13 of stand 100 so as to extract cartridge 3 easily from the roll mill also in case of sticker, leaving the yoke support 6 and the corresponding vertical axis Z roll 2 within the fixed structure 13. For tube rolling symmetry needs, the three capsules 4, 4', 4" of each stand must be designed with the same working stroke and, in this case, the working stroke of the piston 24 of the horizontal capsule 4, which controls the vertical axis roll 2, is oversized considering the needs of the two other capsules 4', 4". By virtue of this, in order to extract the cartridge with the sticked tube, it is possible to arrange a fixing device in the rolling stand 100 to fix the yoke support 6 and the respective vertical axis roll 2 to the hydraulic capsule 4 thereof, thus separating cartridge 3 from roll 2 and from the yoke support 6. In other words, the assembly consisting of roll 2 and yoke support 6 is released from cartridge 3 and anchored instead to the fixed structure 13 of stand 100. Capsule 4 is anchored by fastening the yoke support 6 to capsule 4 which, as the other capsules 4' and 4", is integral with the fixed structure. For this purpose, two supporting elements 14, 14' are provided which have two contact surfaces, forming a 'V'-shaped seat on which the corresponding surfaces 14". 14'" of the yoke support 6 rest, preferably inclined with respect to the horizontal axis Y, so as to keep the yoke support 6 and the respective roll 2 aligned with axis Y, and centered with the 'V'-shaped seat. The supporting surfaces 14, 14'" are configured so as to arrange the guiding surfaces 27, 27' of the yoke support 6 aligned with the guides 22 and 22' when the roll holder cartridge 3 enters and exits from the fixed structure 13 in the extraction position. Furthermore, a balancing device 25 of the yoke support 6 is provided, coaxial with the piston 24 of the hydraulic capsule 4, provided with retractable hammer head that is rotational with respect to the axis Y thereof. The supporting elements 14, 14' produce the reactions needed to support the yoke assembly 6 and roll 2 when cartridge 3 is extracted from the fixed structure 13 and remains fixed to the balancing device.

The stroke of the capsules may be taken to more than 200 mm for a roll mill for tubes up to 10"¾, because the inclined rolls in cartridge change position, and thus with the locking device inserted, must not interfere with the sticked tube. A stroke of approximately 220 mm is in all cases suited to the required performance of the process and considering the use of a capsule with four-way control.

Figure 2:
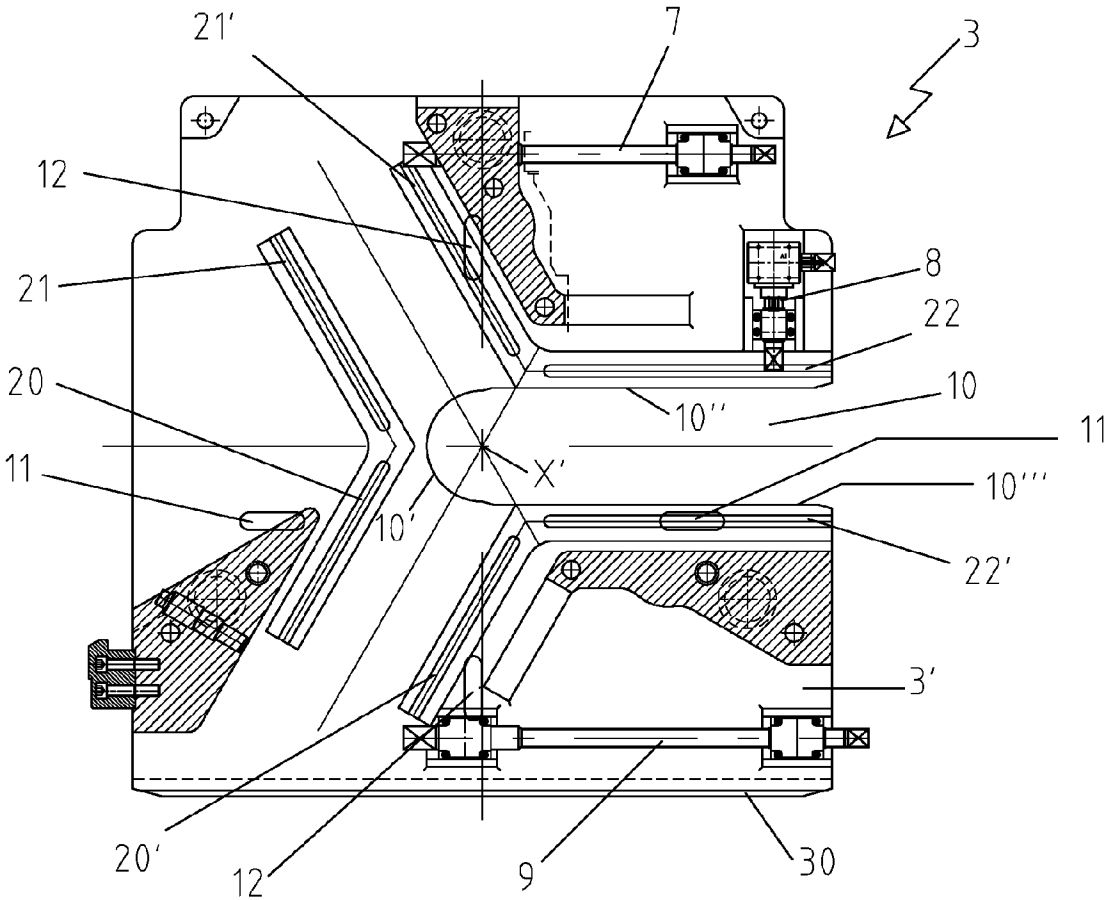
FIG. 2 is a section view taken along a longitudinal plane of a roll holder cartridge of the rolling stand according to the invention without rolling rolls.
Figure 3:
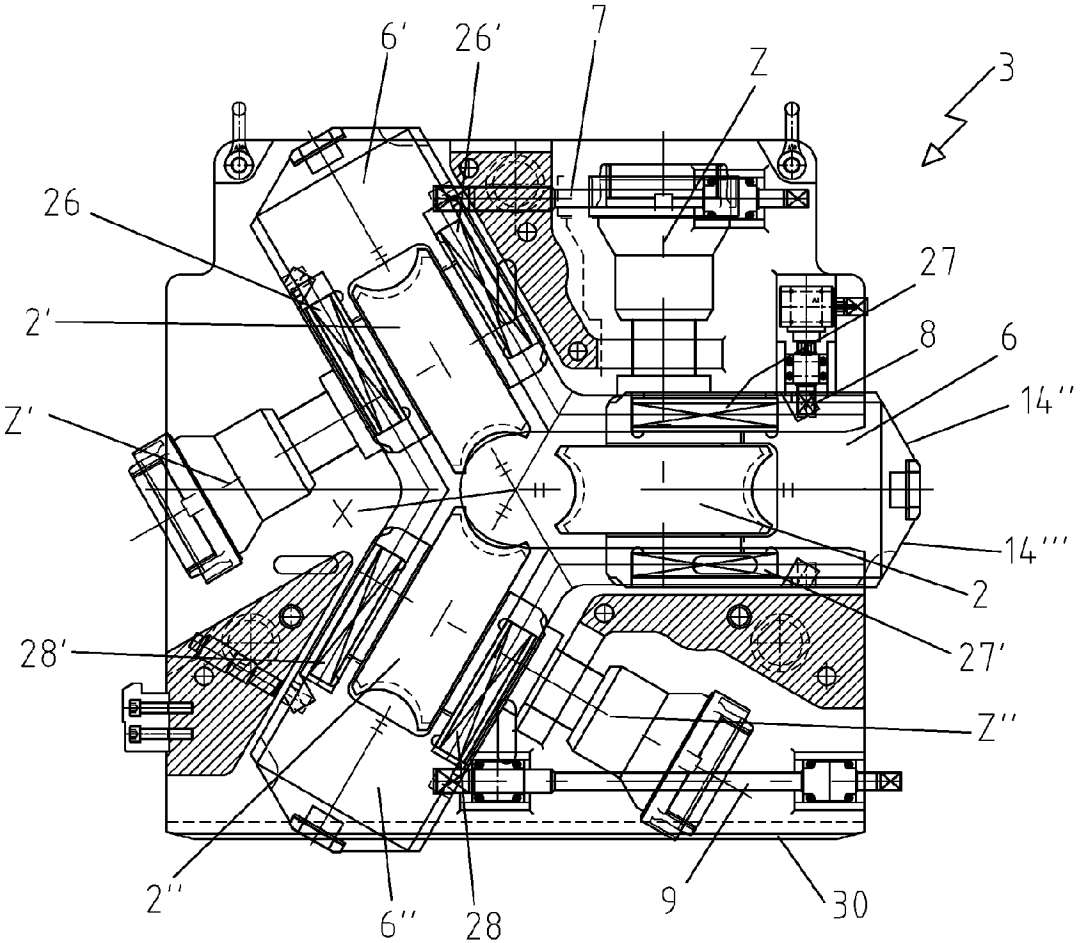
FIG. 3 is a section along a longitudinal plane of a roll holder cartridge of the rolling stand according to the invention with the rolling rolls and the respective yoke supports.
Figure 7:
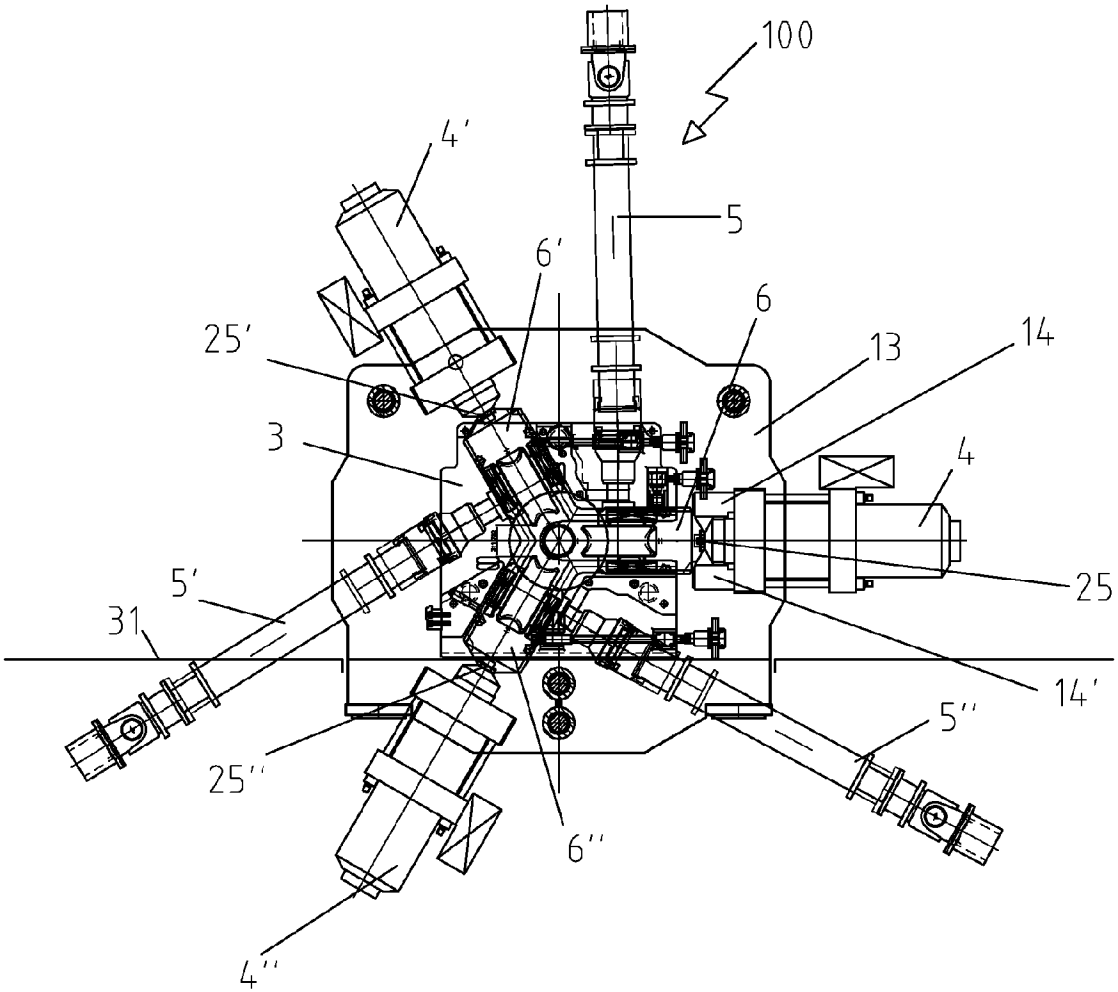
FIG. 7 is a section taken along a longitudinal plane of a rolling stand according to the invention with the roll holder cartridge in a step of maximum opening of the chocks for a first emergency operation in case of sticker or in all cases to provide visual access inside the cartridge.
Figure 8:
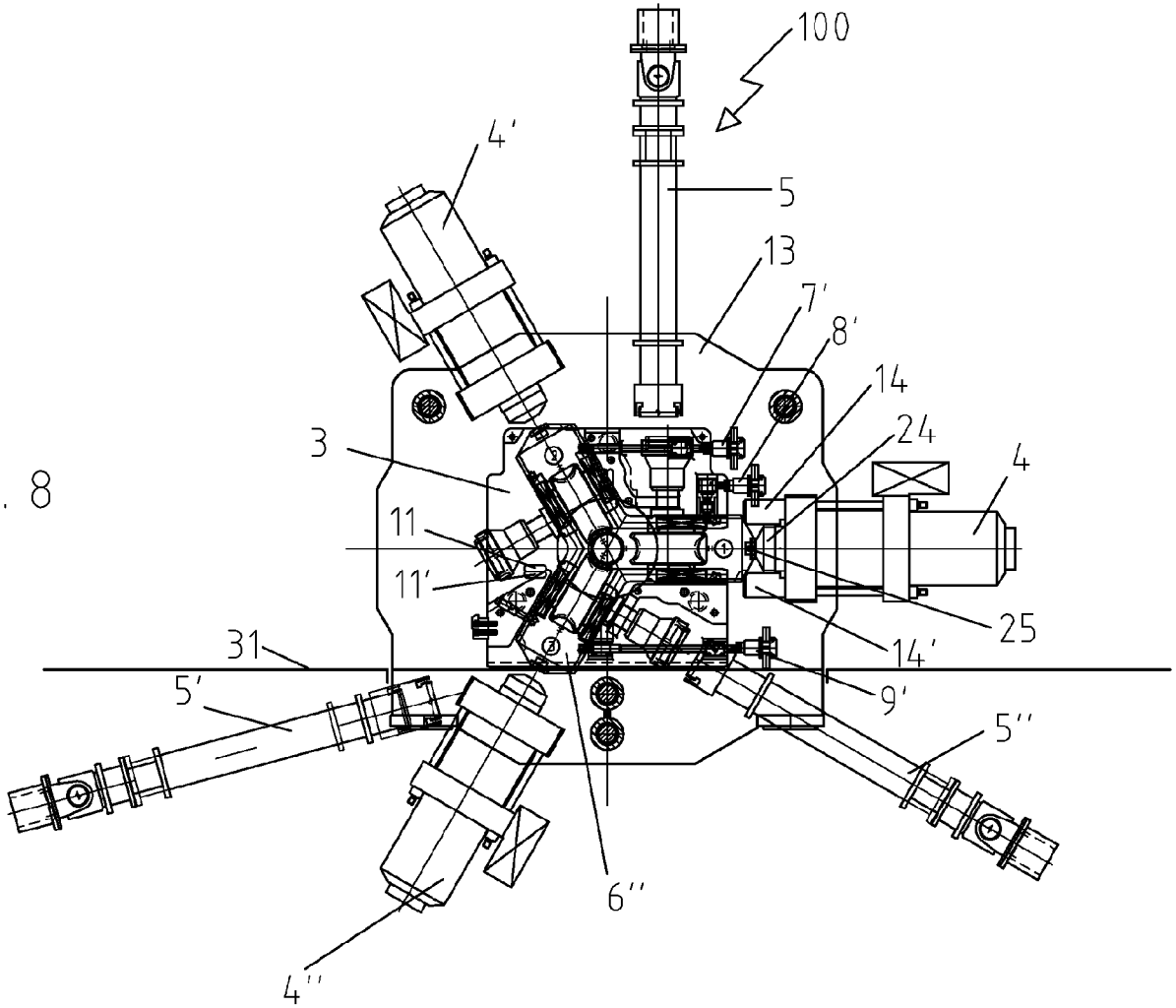
FIG. 8 is the section of a rolling stand according to the invention in a step following that in FIG. 7.
Figure 9:
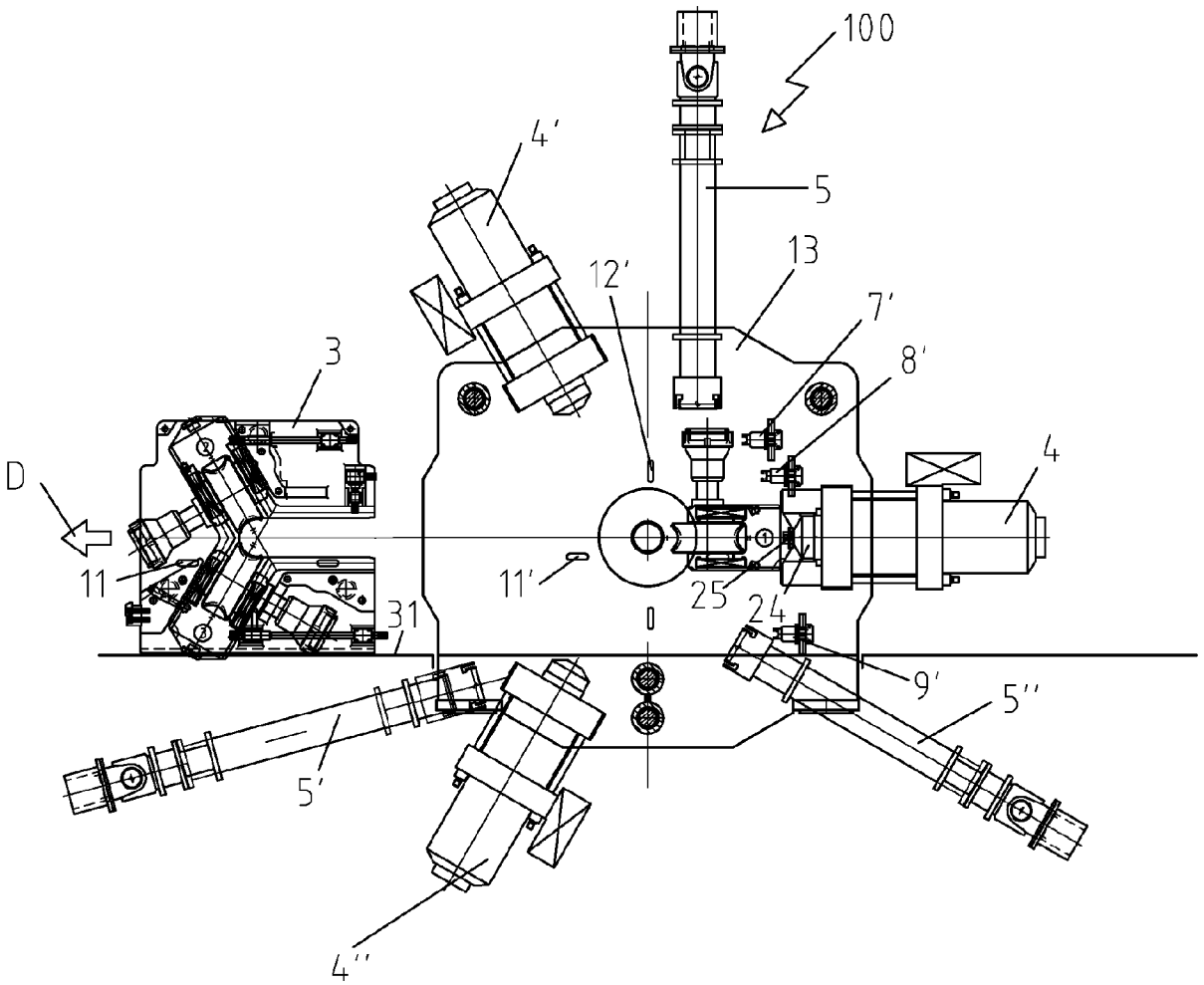
FIG. 9 is a section of a rolling stand according to the invention during a step following that in FIG. 8 with the cartridge extracted and the vertical axis roll under hanging condition from the structure of the stand.

In particular, FIG. 2 shows the structure of cartridge 3 according to the invention which allows to extract it with ease in case of sticked tube. In this figure, only one side wall 3' of cartridge 3 is shown, it being understood that the cartridge also comprises a second wall, which is arranged on a plane closer to the observer, but is not shown because the figure is a section along a vertical plane orthogonal to the axis rolling axis X. It is understood that also the side wall of the cartridge, not shown in this figure, is shaped symmetrically to the wall 3'. The central hole 10 through which the tube to be rolled passes is an open slot, which extends from the centre X' of the cartridge with a semicircle-shaped left part 10', the open central part 10" which extends longitudinally with the sides parallel to the guides 22, 22' and the end 10'" closer to the vertical edges of the roll holder cartridge 3 open. Thereby, the roll holder cartridge 3, which is detached from the yoke support 6 and roller 2 assembly, because it is fastened to the fixed structure 13 by means of the respective hydraulic capsule 4, can be easily removed from the left part (see FIGS. 7, 8 and 9) because the cartridge thus shaped may be pulled out from the sticked tube before even needing to cut it with an gas cutting torch. This shape of the hole 10 allows to extract cartridge 3, in the case of the arrangement 100 of the stand shown in the figures, from the right leftwards so as to leave a large space to intervene on the sticked tube.

Thus, the extraction procedure of the cartridge itself in case of sticker is as follows:

a) the retainer between the yoke support 6 of roll 2 and the roll holder cartridge 3 is unlocked.

b) the extensions 5, 5', 5" are released, c) cartridge 3 is shifted laterally sufficiently to release the alignment key 11 from its support 11' and the roll holder cartridge 3 is lowered from the working position to the extraction position resting the base on the rails 31, d) the yoke support 6 is fastened on the piston 24 of capsule 4 by actuating the hammer head fastening device and the piston 24 is retracted so as to take the yoke support 6 into contact with the supporting elements 14, 14'.

e) the balancing force is maintained on the attachment of the yoke support 6 during the time needed to avoid the sliding of the yoke support 6 on the inclined surfaces or the tipping thereof due to the imbalanced weight, f) the roll holder cartridge 3 is extracted laterally from the fixed structure 13 of stand 100 by means of changing devices (known and not shown), leaving the tube and the mandrel, the vertical axis roll 2 and the respective yoke support 6, in the structure of the roll mill, but freeing one side of the rolling stand by a thickness sufficient to access the sticked tube segment.

Once the sticker has been removed and the roll mill has been freed from the damaged tube and mandrel, the roll holder cartridges 3 are returned to their position, by inserting them back into the roll mill, having provided appropriate lead-ins between the guiding surfaces 27, 27' on the yoke support 6 and the guides 22, 22' on the roll holder cartridge 3 in order to allow the automatic re-introduction of the yoke support 6 hanging horizontally from capsule 4 into the roll holder cartridge 3.

With the present invention it is possible to extract the roll holder cartridge 3 completely using the normal cartridge change devices existing in existing roll mills, eliminating all the factors which prevent such an extraction when the tube and the mandrel operating therein are blocked in the machine. Obviously, the operating advantage of this method of extracting the roll holder cartridge in case of sticker is very important and allows to drastically reduce the roll mill downtime for removing sticker and further allows operators to operate under improved accessibility and safety conditions when compared with the prior art.

The invention claimed is:

1. A rolling stand, defining a rolling axis, comprising a support structure, a roll holder cartridge configured to go from a working position inside the support structure, at said rolling axis, to an extracted position outside the support structure with a transverse movement with respect to the rolling axis, three rolling rolls, each of which having a respective yoke support, arranged in the roll holder cartridge with axes thereof arranged at 120° with respect to one another, a first rolling roll of said three rolling rolls having rotation axis thereof arranged vertically, at least one hydraulic capsule for each rolling roll fixed to the support structure, for adjusting a radial position of the respective rolling roll, the hydraulic capsule having a respective thrust cylinder and being configured to allow the respective thrust cylinder to cover a distancing stroke from the rolling axis sufficient to allow to clear the path of the roll holder cartridge between the working position and the extracted position, wherein the roll holder cartridge has a longitudinal open slot with a central axis that coincides with a longitudinal central axis of the yoke support of the first rolling roll, and a width in vertical direction greater than a diameter of a tube being rolled, said longitudinal open slot being closed at a first end near the rolling axis and open at a second end opposite to the first end and coinciding with a side of the roll holder cartridge, considering the position assumed by the roll holder cartridge when it is inserted in the rolling stand.

2. A rolling stand according to claim 1, comprising a locking device of the position of the yoke supports inside the roll holder cartridge.

3. A rolling stand according to claim 1, wherein the hydraulic capsules are four-way capsules.

4. A rolling stand according to claim 1, comprising a balancing device of the yoke support of the first rolling roll that is coaxial with a piston of the corresponding hydraulic capsule and provided with a hammer head that is retractable and rotational with respect to an axis thereof.

5. A rolling stand according to claim 1, wherein a V-shaped seat is arranged on a fixed structure formed by two supporting planes inclined with respect to a horizontal axis and aligned with guides of the yoke support for centering and supporting the yoke support of the first rolling roll when it is withheld by the corresponding hydraulic capsule.

6. A method for releasing a rolling stand according to claim 1 in case of sticking of a tube during rolling operations, said method comprising in sequence the following steps of:

a) releasing a retainer between yoke support of the first rolling roll and the roll holder cartridge, b) releasing extensions, c) shifting the roll holder cartridge laterally from the working position to the extraction position, d) retracting a piston of a horizontal axis hydraulic capsule so as to move inclined planes of the corresponding yoke support into contact with reaction surfaces integral with the support structure of the rolling stand, e) maintaining a balancing force during an entire time needed to avoid a sliding of the yoke support of the first rolling roll on the inclined planes or a tipping thereof due to an unbalanced weight, f) extracting the roll holder cartridge leaving the yoke support with the first rolling roll on the support structure of the rolling stand.

* * * * *